US005898147A

United States Patent [19]

Domzalski et al.

[11] Patent Number: 5,898,147

[45] Date of Patent: Apr. 27, 1999

[54] DUAL TACT SWITCH ASSEMBLY

[75] Inventors: Frank M. Domzalski, Framingham; William J. Agnatovech, Franklin, both of Mass.

[73] Assignee: C & K Components, Inc., Watertown, Mass.

[21] Appl. No.: 08/960,005

[22] Filed: Oct. 29, 1997

[51] Int. Cl.[6] ..... H01H 1/06; H01H 5/26; H01H 9/00; H01H 13/70

[52] U.S. Cl. ..... 200/1 B; 200/5 A; 200/406; 200/516; 200/517

[58] Field of Search ..... 200/1 B, 5 B, 200/5 A, 275, 406, 512, 513, 514, 515, 516, 517

[56] References Cited

U.S. PATENT DOCUMENTS

| | | | |
|---|---|---|---|
| 3,600,528 | 8/1971 | Leposavic | 200/5 A |
| 3,941,946 | 3/1976 | Yoder | 200/275 X |
| 3,969,595 | 7/1976 | Johnson | 200/5 A |
| 3,996,429 | 12/1976 | Chu et al. | 200/5 A |
| 4,029,916 | 6/1977 | Chu | 200/5 A |
| 4,359,614 | 11/1982 | Green et al. | 200/5 R |
| 4,439,646 | 3/1984 | Bouvrande | 200/5 A |
| 4,659,881 | 4/1987 | Dowe | 200/5 R |
| 4,771,139 | 9/1988 | Desmet | 200/5 A |
| 4,778,952 | 10/1988 | Watkins et al. | 200/5 A |
| 4,978,818 | 12/1990 | Rothlin | 200/406 |
| 5,313,027 | 5/1994 | Inoue et al. | 200/5 A |
| 5,320,226 | 6/1994 | Merrill | 206/521 |
| 5,412,164 | 5/1995 | Conway et al. | 200/1 B |
| 5,430,261 | 7/1995 | Malone et al. | 200/1 B |
| 5,510,584 | 4/1996 | Norris | 200/5 A |
| 5,559,311 | 9/1996 | Gorbatoff | 200/513 |
| 5,564,560 | 10/1996 | Minelli et al. | 200/516 |

*Primary Examiner*—J. R. Scott
*Attorney, Agent, or Firm*—Pearson & Pearson

[57] ABSTRACT

A dual action, convex disc push-button switch assembly providing tactile feedback to the operator. Each convex disc contact comprises four tabs, each tab of which is fitted and secured in the base of the switch assembly making the switch easy to assemble and operate reliably. The tabs of a first convex disc contact are positioned forty-five degrees relative to the tabs of a second convex disc contact. The switch is sealed thereby permitting various ways to secure the switch terminals to an electronic board.

26 Claims, 6 Drawing Sheets

DUAL TACT SWITCH ASSEMBLY

BACKGROUND OF THE INVENTION

1. Field of the Invention

This invention relates to push button electrical switches and in particularly to an improved, sealed, dual action, tactile feedback, switch assembly having three states or functions.

2. Description of Related Art

It is a constant requirement that switches be made more compact, requiring a minimum of space in an apparatus and yet be simple and reliable. It is another requirement that the switches be sealed in order to be applicable for installation on boards where fluid techniques such wave soldering are used. If the switch is not sealed, internal corrosion of the contacts due to contaminants would occur in the switch.

In addition, for certain applications, the operator expects to feel a switching action such as when going from one switch function to another. In the case of switches having internal contacts implemented with convex discs or domes positioned one above the other in a spaced relationship having their respective centers substantially in alignment. A flex or snap-action occurs when an operator pushes down on a push button which applies a force to the center of the domes. The operator can sense the snapping movement of the center portion of a first dome and then the snapping movement of the center portion of a second dome positioned under the first dome. This sensation is commonly known as "tactile feedback". The flexing of the dome causes an electrical connection to occur first between the upper dome and the lower dome, and then with further pressure on the push button, the lower dome makes electrical connection with a terminal in the base of the switch assembly. Thus, such a switch has a normally open position and two other positions for making electrical connection. Such a switch assembly has to be assembled with low cost parts and low cost efficient means in order to be viable in the market place. Securing the lower dome may provide wider applicability of the switch.

U.S. Pat. No. 4,029,916 issued Jun. 14, 1977 to Pak-Jong Chu discloses a multi-contact push-button switch which has a spring contact plate and a circuit board in superposed position. The spring contact plate has one or more switched positions, each switch position comprising a prestressed domed portion surrounded by a flat short portion. Spring contacts extend radially from the central portion, each contact between a pair of webs. A push button acts on the central portion and pressure on the push button causes the central portion to snap through the plane of the flat sheet portion, with the spring contacts contacting contact areas on the circuit board. However, the switch configuration requires larger packaging and the snap action of one dome provides poorer tactile feed than two dome switches.

U.S. Pat. No. 4,659,881 issued Apr. 21, 1987 to David R. Dowe discloses a multidome switch assembly comprising a pair of conducting resilient domes which snap inwardly to produce corresponding switching functions when downward pressure is applied at the respective centers, and snap outwardly to produce opposite switching functions when the applied pressure is removed. Successive snapping action of the two domes produce corresponding switching functions to provide respective stages of tactile feedback through the push button to the operator. However, securing the lower dome is often a problem to prevent contact with the upper dome especially if the switch is turned upside down. Also, the switch is not a sealed switch which limits its method of connection to a component board.

U.S. Pat. No. 5,564,560 issued Oct. 15, 1996 to Jeffrey D. Minelli et al discloses a dual function button 10 for keyboards and keypads. The button includes a first contact switch which is activated by a first manual pressure. The first control switch is preferably formed by a resilient cover having a conductive pellet on its interim face, and a flexible substrate having spaced contacts below the pellet. The first manual pressure causes the pellet to impinge upon the spaced contacts below the pellets. The first manual pressure causes the pellet to impinge upon the spaced contacts completing a first circuit. The button includes a second contact switch which is activated by a second, greater, manual pressure. The second contact switch includes the resilient cover of the first contact switch, a rigid substrate mounting spaced contacts and a flexible conductive dome mounted on the rigid substrate below the resilient cover. The second manual pressure causes the dome to resiliently deform and impinge upon the contacts closing the second switch. However, this switch is not a discrete component switch and the means for retention of the conductive dome is not clear.

SUMMARY

Accordingly, it is therefore an object of this invention to provide an improved, low cost, small, sealed, tactile feedback, push button switch.

It is another object of the invention to provide a tactile feedback, switch assembly having double convex disc contacts in a spaced apart relationship with their center substantially in alignment.

It is a further object of this invention to provide a tactile feedback switch assembly having double convex disc contacts, each of such convex disc contacts having tabs for easily securing the contacts to a base of the switch assembly.

It is another object of the invention to provide an upper convex disc contact as the tactile feedback switch assembly having a recessed section at the apex for concentrating the force in the center of the convex disc contact and for making a reliable electrical connection when the switch is actuated.

These and other objects are accomplished by an improved electrical switch assembly of the type wherein an operator senses tactile feedback from switch contacts flexing when pressure is applied to said switch assembly, comprising a first convex disc contact having a plurality of tabs extending therefrom, a second convex disc contact having a plurality of tabs extending therefrom, the first convex disc contact positioned above the second convex disc in a spaced apart relationship having their centers substantially aligned, base means for supporting the first convex disc contact above the second convex disc contact, the tabs of the first convex disc contact being rotated approximately forty-five degrees relative to the tabs of the second convex disc contact, and actuator means positioned above the first convex disc contact and adjacent thereto for moving a first predetermined distance causing the first convex disc contact to flex and be in electrical contact with the second convex disc contact and moving a second predetermined distance causing the second convex disc contact to flex and be in electrical contact with a base contact. Respective stages of the tactile feedback are provided by the flexing of the first convex disc contact and the second convex disc contact in response to movement of the applied pressure to the first predetermined distance and the second predetermined distance, the first convex disc contact and the second convex disc contact returning to their original non-flex state when the applied pressure is removed. The first convex disc contact comprises a recessed means at the center of the disc for concentrating the applied pressure on the second convex disc contact. A plate means is used for retaining the actuator means within the switch assembly. The plate means comprises an opening for a push button portion of the actuator means to extend through the opening for operator access.

The base means comprises a first plurality of multi-sided bins for positioning the tabs of the first convex disc contact in a first plane, and the base means comprises a second plurality of multi-sided bins for positioning the tabs of the second convex disc contact, the second plurality of multi-sided bins being positioned approximately forty-five degrees from the first plurality of the multi-sided bins and in a second plane above the first plane. The base means comprises a first terminal connected to the first convex disc contact, the first terminal extending outside the base means. The base means comprises a second terminal connected to the second convex disc contact, the second terminal extending outside the base means. The base means also comprises a third terminal connected to the base contact within the base means, the third terminal extending outside the base means.

The objects are further accomplished by a dual tactile switch assembly comprising base means for supporting convex contacts of the switch assembly, means provided in a first plane within the base means for positioning a plurality of tabs of a first of the convex contacts, means provided in a second plane in the base means below the first plane for securing a plurality of tabs of a second of the convex contacts, the second of the convex contacts tabs being displaced approximately forty-five degrees relative to the tabs of the first of the convex contacts, actuator means, positioned above the first of the convex contacts, for causing the first of the convex contacts to flex, when pressure is applied to move the actuator means a predetermined distance, thereby causing the first of the convex contacts to come into electrical contact with the second of the convex contacts, and with additional pressure applied to move the actuator a second predetermined distance causing the second of the convex contacts to flex and be in electrical contact with a base contact, the first of the convex contacts and the second of the convex contacts returning to a non-flex state when the applied pressure is removed, and means for retaining the actuator means, within the switch assembly, the retaining means having a plate with slides for attaching to at least two opposite sides of the base means. The first of the convex contacts comprises a recessed means at the center of the first of the convex contacts for concentrating the applied pressure on the second of the convex contacts. An operator of the switch assembly senses tactile feedback when the first of the convex contacts is caused to flex and when the second of the convex contacts is caused to flex.

The objects are further accomplished by a method of providing an improved electrical switch assembly of the type wherein an operator senses tactile feedback from switch contacts flexing when pressure is applied to the switch assembly, comprising the steps of providing a first convex disc contact having a plurality of tabs extending therefrom, providing a second convex disc contact having a plurality of tabs extending therefrom, positioning the first convex disc contact above the second convex disc in a spaced apart relationship having their centers substantially aligned, supporting the first convex disc contact above the second convex disc contact in a base means, the tabs of the first convex disc contact being rotated approximately forty-five degrees relative to the tabs of the second convex disc contact, and positioning an actuator means above the first convex disc contact and adjacent thereto for moving a first predetermined distance causing the first convex disc contact to flex and be in electrical contact with the second convex disc contact and moving a second predetermined distance causing the second convex disc contact to flex and be in electrical contact with a base contact. The step of providing respective stages of the tactile feedback by the flexing of the first convex disc contact and the second convex disc contact in response to movement of the applied pressure to the first predetermined distance and the second predetermined distance, the first convex disc contact and the second convex disc contact returning to their original non-flex state when the applied pressure is removed. The step of providing the first convex disc contact comprises the step of providing a recessed means at the center of the disc for concentrating the applied pressure on the second convex disc contact. The step of providing a plate means for retaining the actuator means within the switch assembly.

The objects are further accomplished by a method of providing a dual tactile switch assembly comprising the steps of supporting convex contacts of the switch assembly in a base means, positioning a plurality of tabs of a first of the convex contacts in means provided in a first plane within the base means, securing a plurality of tabs of a second of the convex contacts in means provided in a second plane in the base means below the first plane, the second of the convex contact tabs being displaced approximately forty-five degrees relative to the tabs of the first of the convex contacts below the first plane, positioning an actuator means above the first of the convex contacts for causing the first of the convex contacts to flex, when pressure is applied to move the actuator means a predetermined distance, thereby causing the first of the convex contacts to come into electrical contact with the second of the convex contacts, and with additional pressure applied to move the actuator a second predetermined distance, causing the second of convex contacts to flex and be in electrical contact with a base contact, the first of the convex contacts and the second of the convex contacts returning to a non-flex state when the applied pressure is removed, and retaining the actuator means within the switch assembly, with plate means having at least two sides for attaching to at least two opposite sides of the base means.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF PREFERRED EMBODIMENT

Figure 1:
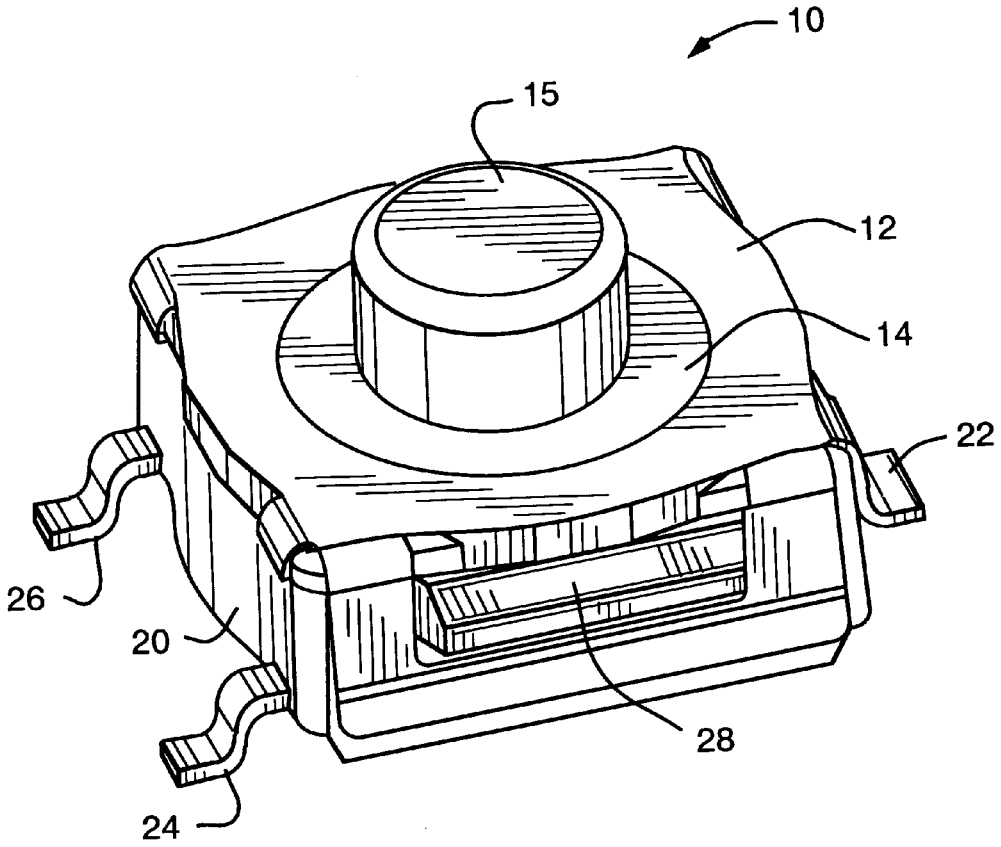
FIG. 1 is a perspective view of the invention of an improved dual tact switch assembly.

Referring to FIG. 1, a perspective view of the invention of an improved dual tactile ("tact"), push-button switch assembly 10 is shown comprising a base 20 having a terminal 22 extending from one side of the base 20, and two terminals 24, 26 extending from an opposite side of the base 20. An actuator 14 extends above the base 20 and the lower portion of the actuator 14 is secured within the base 20 by a surface plate 12 having an opening on top for the actuator button 15 to protrude through. The surface plate 12 is secured to the base 20 by flanges 28, 30 on opposite sides of the base 20. Each of the flanges 28, 30 protrude into openings on two sides of the surface plate 12 for holding the actuator 14 within the switch 10.

Figure 2A:
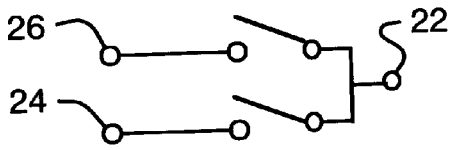
FIGS. 2A, 2B and 2C show electrical schematics of the dual tact switch in the normally open position, in position 1 and in position 2.
Figure 2B:
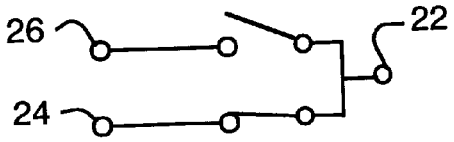
Figure 2C:
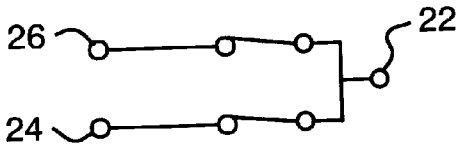

Referring now to FIGS. 2A, 2B and 2C, electrical schematics of the dual tact switch assembly 10 are shown. FIG. 2A shows the switch contacts in the normally open position. FIG. 2B shows the contacts in a first closed position whereby an electrical signal on terminal 22 is transferred to terminal 24. FIG. 2C shows the contacts in a second closed position whereby the electrical signal on terminal 22 is transferred to both terminals 24, 26.

The push-button switch assembly 10 is designed to provide tactile feedback to an operator when pressure is applied to the push-button 15 and the switch proceeds from a normally open position to the first closed position as shown in FIGS. 2A, 2B and 2C. The tactile feedback results from the flexing of a first convex disc contact 16 and a second convex disc contact 18 shown in FIG. 3.

Figure 3:
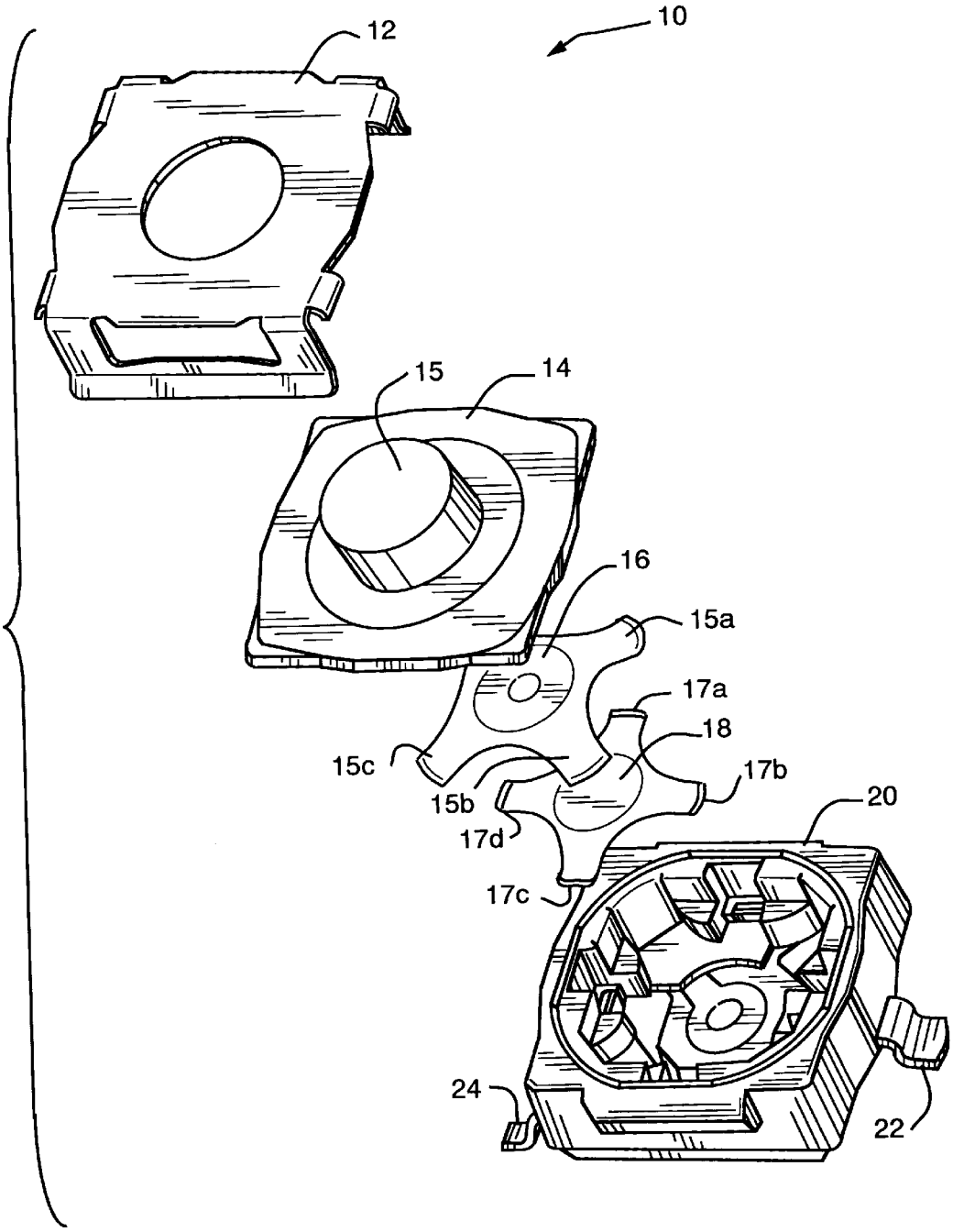
FIG. 3 is an exploded perspective view showing the elements of the dual tact switch assembly of FIG. 1.

Referring now to FIG. 3, an exploded perspective is shown of the elements of the dual tact switch assembly 10 of FIG. 1. In addition to the surface plate 12 and the actuator 14, the first or large convex disc contact 16 and the second or small convex disc contact 18 both of which are positioned into the base 20 with their tabs 15*a*–15*d* and 17*a*–17*d* respectively, rotated 45 degrees relative to each other. The first convex disc contact 16 has dimensions slightly larger than the second convex disc contact 18 to facilitate their stacked position in the base 20.

Figure 4:
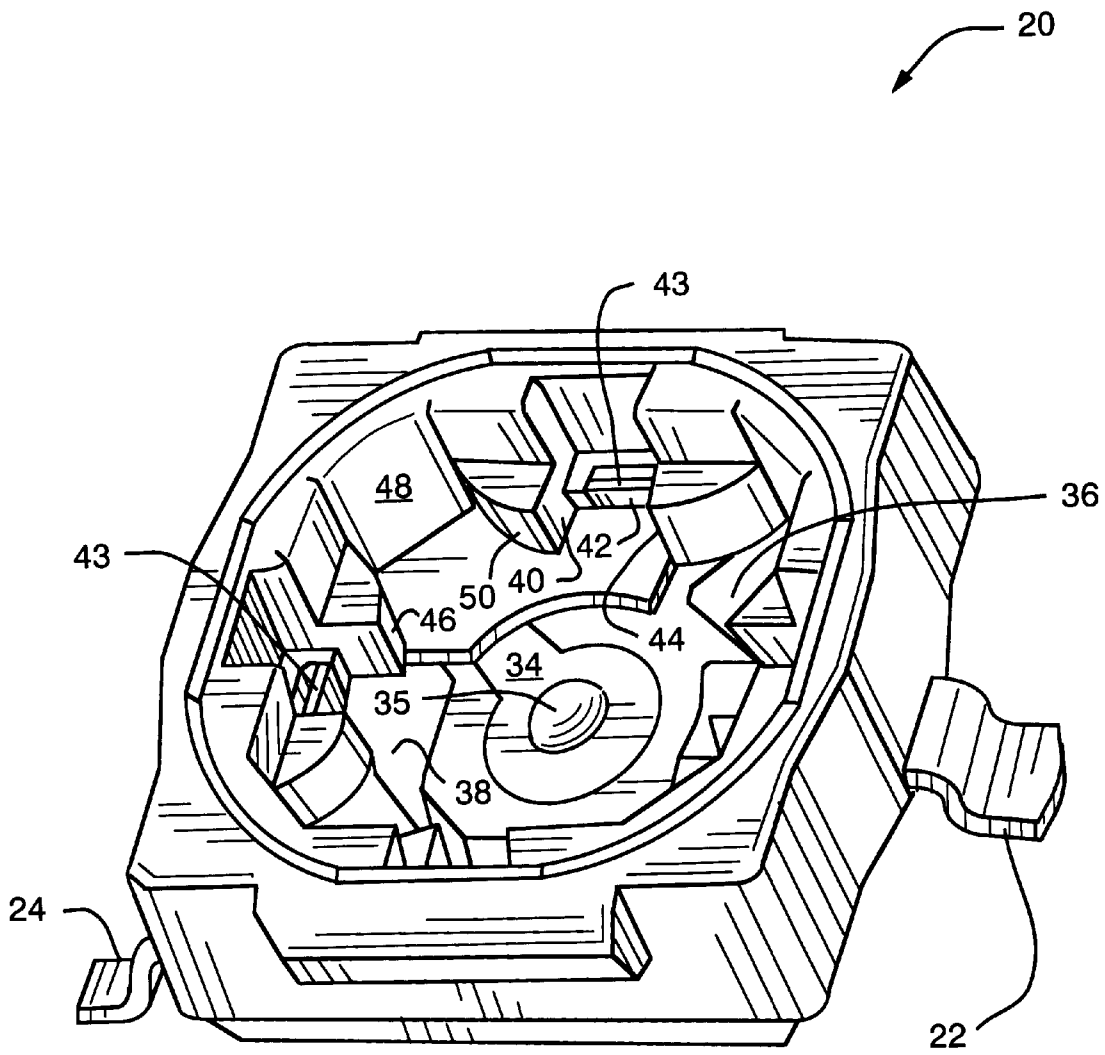
FIG. 4 is a perspective view of the base of the switch assembly showing a center contact and two of the three terminals extending from opposite sides of the base.
Figure 10:
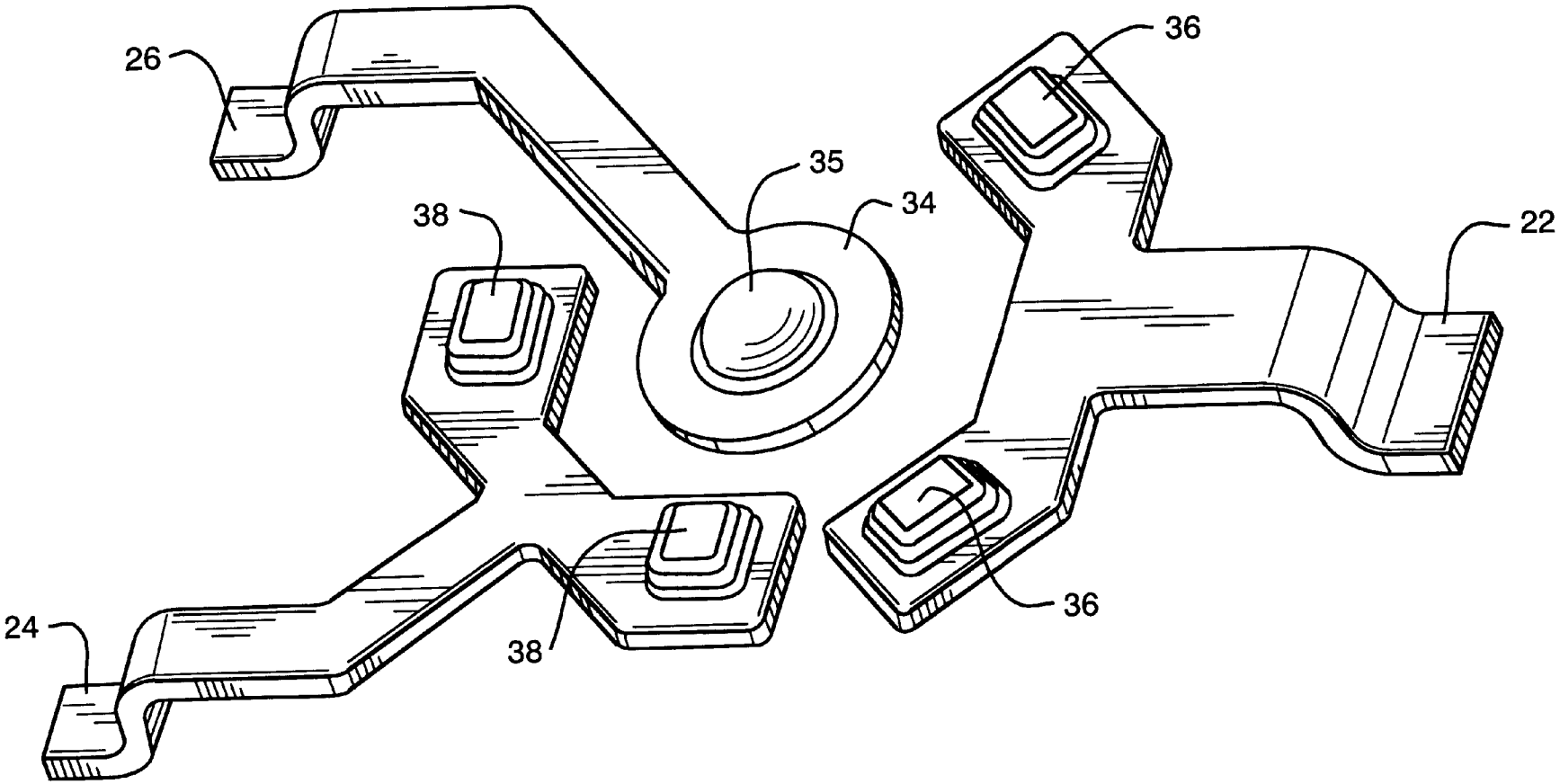
FIG. 10 shows in perspective strip terminals having contacts which are positioned within the base of the switch assembly and the strip terminals extend outside the base of the switch assembly.

Referring to FIG. 4 and FIG. 10, FIG. 4 shows a perspective view of the base 20 of the dual tach switch assembly 10 and FIG. 10 shows the terminals 22, 24, 26 which extend into the base 20 providing contacts 36 38 and 34 respectively. The center contact 34 is shown having a bump 35, and the bump 35 provides a force concentration point when the actuator button 15 is pushed downward to make a reliable electrical contact between the bottom contact 34 and the second convex disc contact 18. Contact 34 is disposed on an end of strip terminal 26 within the base 20. Also, contacts 36 are disposed on ends of strip terminal 22 within the base 20. Further, contacts 38 are disposed on ends of strip terminal 24 within the base 20. The base 20 is designed to allow the rapid insertion of the second convex disc contact 18 and the first convex disc contact 16 into the base and provide for their retention within the base.

The interior design of base 20 provides three-sided bins for each tab of the convex disc contacts 16, 18 to be placed therein. For example, a bin comprising three walls 40, 42, and 44 surrounds the tab 17*d* of the second convex disc contact 18 and a bin comprising three walls 46, 48, 50 surrounds the tab 15*d* of the first convex disc contact 16. Similar walls forming bins are provided for each of the four tabs 17*a*–17*d* of the second convex disc contact 18 and each of the tabs 15*a*–15*d* of the first convex disc contact 16. The tabs 17*a*–17*d* of the second convex disc contact 18 are secured on the plateau upon which they rest by retention protrusions 43 positioned above wall 42. After insertion of the second convex disc contact 18 into its position in the base 20, the protrusion 43 is deformed by cold staking or heat staking to extend over the tab, such as tab 17*a*, thereby preventing the second convex disc contact 18 from moving out of its position in the base 20. The base 20 configuration permits easy assembly of the switch and reliable operation, and it is molded with a high temperature thermal plastic which is known in the art.

Figure 5:
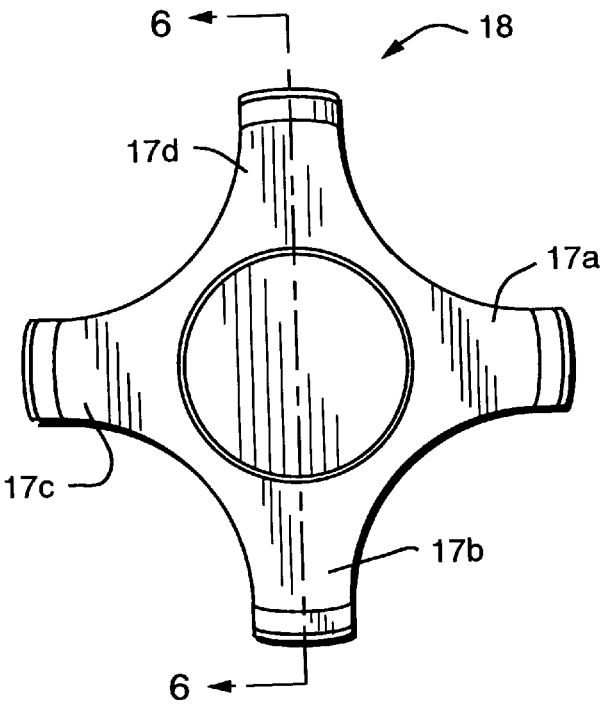
FIG. 5 shows a top view of a small or second convex disc contact having four tabs for positioning in the dual tact switch assembly.
Figure 6:
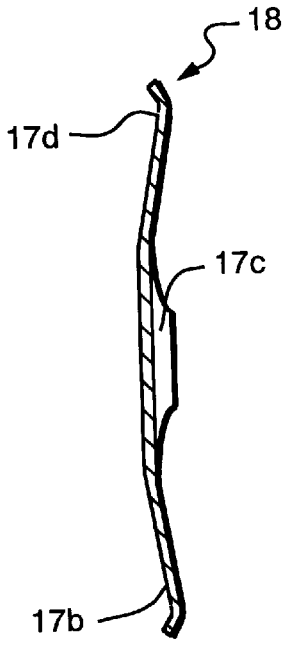
FIG. 6 shows a cross-section of the small or second convex disc contact of FIG. 5.

Referring to FIG. 5 and FIG. 6, FIG. 5 shows a top view of the second convex disc contact 18 having four tabs 17*a*–17*d* and FIG. 6 shows a side view of the same contact 18. This second convex disc contact 18 is positioned within the base so that two of its four tabs 17*a*–17*d* rest on top of contacts 38. FIG. 6 shows the curvature of the small convex contact 18.

Figure 7:
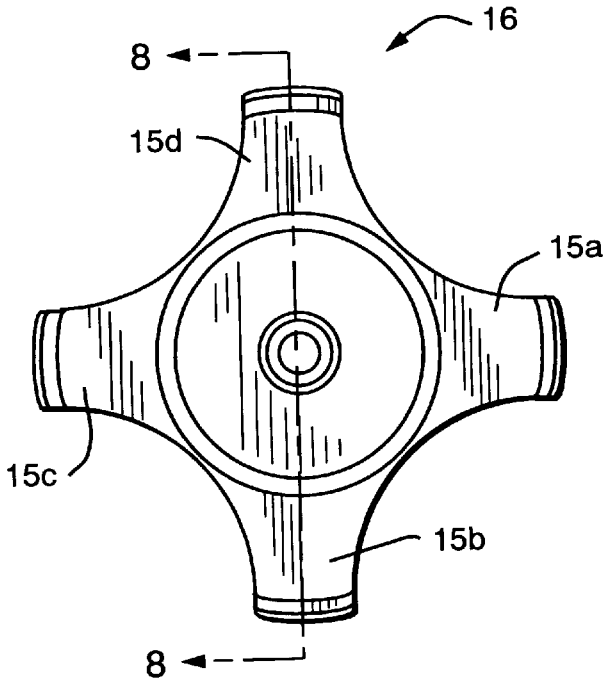
FIG. 7 shows a top view of a large or first convex disc contact having four tabs for positioning in the dual tact switch assembly.
Figure 8:
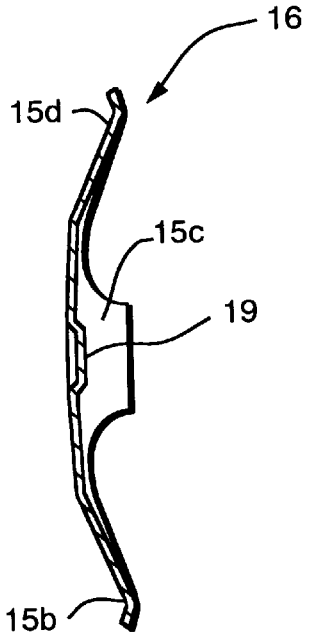
FIG. 8 shows a cross-section of the large or first convex disc contact of FIG. 7 having a recessed portion at the center of the disc contract.

Referring to FIG. 7 and FIG. 8, FIG. 7 shows a top view of a first convex disc contact 16 having four 4 tabs 15*a*–15*d*, and FIG. 8 shows a cross-sectional side view of the same convex disc contact 16. Also shown in FIG. 8 is a recessed section 19 which makes contact with the second convex disc contact 18 when the button 15 is pushed. The recessed section 19 provides for concentrating the applied force on the center of the second convex disc contact 18 and also provides for a good, reliable electrical connection. Two of the four tabs 15*a*–15*d* rest on top of contacts 36.

Figure 9:
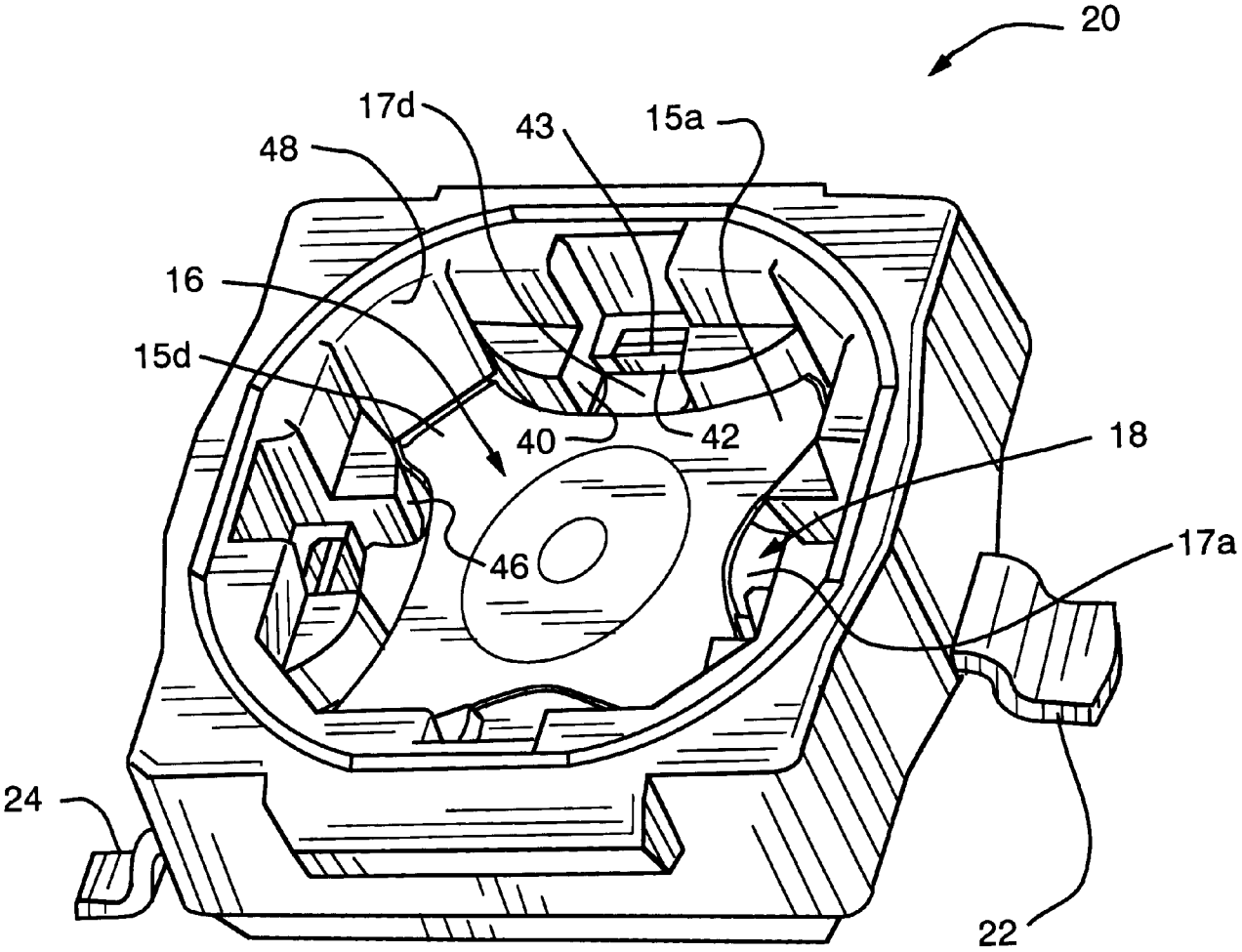
FIG. 9 is a perspective view of the base of the switch assembly showing the small convex disc contact positioned under the large convex disc contact with the tabs of the small convex disc contact rotated 45 degrees relative to the tabs of the large convex disc contact.

Referring now to FIG. 9, a perspective view of the base 20 of switch assembly 10 is shown with the small or second convex disc contact 18 positioned under the large or first convex disc contact 16 with the tabs 17*a*–17*d* of the second convex disc contact 18 rotated 45 degrees relative to the tabs 15*a*–15*d* of the first convex disc contact 16. As described for FIG. 4 above, the base 20 design provides three side walls for each tab of each convex disc contacts 16, 18 to keep them from moving and touching each other and to avoid causing an electrical malfunction.

The actuator 14, which comprises a silicon elastomer commonly known in the art, is positioned on top of the first convex disc contact 16 and the surface plate 12 is placed over the assembly 10 with the push button 15 of the actuator 14 extending through the hole in the surface plate 12. The dual tack switch assembly 10 is sealed by the compression of the elastomer actuator 14 between surface plate 12 and the base 20, and by the plastic base 20 molded around the metal terminals 22, 24, 26. The sealing of the switch assembly 10 permits various ways to secure the switch terminals 22, 24, 26 to an electronic component board or printed circuit board.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. An improved electrical switch assembly of the type wherein an operator senses tactile feedback from switch contacts flexing when pressure is applied to said switch assembly, comprising:

first convex disc contact having a plurality of tabs extending therefrom;

second convex disc contact having a plurality of tabs extending therefrom;

said first convex disc contact positioned above said second convex disc in a spaced apart relationship having their centers substantially aligned;

base means for supporting said first convex disc contact above said second convex disc contact, said tabs of said first convex disc contact being rotated approximately forty-five degrees relative to said tabs of said second convex disc contact; and actuator means positioned above said first convex disc contact and adjacent thereto for moving a first predetermined distance causing said first convex disc contact to flex and be in electrical contact with said second convex disc contact and moving a second predetermined distance causing said second convex disc contact to flex and be in electrical contact with a base contact.

2. The improved electrical switch assembly as recited in claim 1 wherein respective stages of said tactile feedback are provided by the flexing of said first convex disc contact and said second convex disc contact in response to movement of said applied pressure to said first predetermined distance and said second predetermined distance, said first convex disc contact and said second convex disc contact returning to their original non-flex state when said applied pressure is removed.

3. The improved electrical switch assembly as recited in claim 1 wherein said first convex disc contact comprises a recessed means at the center of said disc for concentrating said applied pressure on said second convex disc contact.

4. The improved electrical switch assembly as recited in claim 1 comprises a plate means for retaining said actuator means within said switch assembly.

5. The improved electrical switch assembly as recited in claim 4 wherein said plate means comprises an opening for a push button portion of said actuator means to extend through said opening for operator access.

6. The improved electrical switch assembly as recited in claim 1 wherein said base means comprises a first plurality of multi-sided bins for positioning said tabs of said first convex disc contact in a first plane; and said base means comprises a second plurality of multi-sided bins for positioning said tabs of said second convex disc contact, said second plurality of multi-sided bins being positioned approximately forty-five degrees from said first plurality of said multi-sided bins and in a second plane above said first plane.

7. The improved electrical switch assembly as recited in claim 1 wherein said base means comprises a first terminal connected to said first convex disc contact, said first terminal extending outside said base means.

8. The improved electrical switch assembly as recited in claim 1 wherein said base means comprises a second terminal connected to said second convex disc contact, said second terminal extending outside said base means.

9. The improved electrical switch assembly as recited in claim 1 wherein said base means comprises a third terminal connected to said base contact within said base means, said third terminal extending outside said base means.

10. A dual tactile switch assembly comprising:

base means for supporting convex contacts of said switch assembly;

means provided in a first plane within said base means for positioning a plurality of tabs of a first of said convex contacts;

means provided in a second plane in said base means below said first plane for securing a plurality of tabs of a second of said convex contacts, said second of said convex contacts tabs being displaced approximately forty-five degrees relative to said tabs of said first of said convex contacts;

actuator means, positioned above said first of said convex contacts, for causing said first of said convex contacts to flex, when pressure is applied to move said actuator means a predetermined distance, thereby causing said first of said convex contacts to come into electrical contact with said second of said convex contacts, and with additional pressure applied to move said actuator a second predetermined distance causing said second of said convex contacts to flex and be in electrical contact with a base contact, said first of said convex contacts and said second of said convex contacts returning to a non-flex state when said applied pressure is removed; and means for retaining said actuator means, within said switch assembly, said retaining means having a plate with sides for attaching to at least two opposite sides of said base means.

11. The dual tactile switch assembly as recited in claim 10 wherein said first of said convex contacts comprises a recessed means at the center of said first of said convex contacts for concentrating said applied pressure on said second of said convex contacts.

12. The dual tactile switch assembly as recited in claim 10 wherein an operator of said switch assembly senses tactile feedback when said first of said convex contacts is caused to flex and when said second of said convex contacts is caused to flex.

13. The dual tactile switch assembly as recited in claim 10 wherein said retaining means comprises an opening in a portion of said plate for a push button portion of said actuator means to extend through said opening for operator access.

14. The dual tactile switch assembly as recited in claim 10 wherein said base means comprises a first terminal connected to said first of said convex contacts, said first terminal extending outside said base means.

15. The dual tactile switch assembly as recited in claim 10 wherein said base means comprises a second terminal connected to said second of said convex contacts, said second terminal extending outside said base means.

16. The dual tactile switch assembly as recited in claim 10 wherein said base means comprises a third terminal connected to said base contact within said base means, said third terminal extending outside said base means.

17. A method of providing an improved electrical switch assembly of the type wherein an operator senses tactile feedback from switch contacts flexing when pressure is applied to said switch assembly, comprising the steps of:

providing a first convex disc contact having a plurality of tabs extending therefrom;

providing a second convex disc contact having a plurality of tabs extending therefrom;

positioning said first convex disc contact above said second convex disc in a spaced apart relationship having their centers substantially aligned;

supporting said first convex disc contact above said second convex disc contact in a base means, said tabs of said first convex disc contact being rotated approximately forty-five degrees relative to said tabs of said second convex disc contact; and positioning an actuator means above said first convex disc contact and adjacent thereto for moving a first predetermined distance causing said first convex disc contact to flex and be in electrical contact with said second convex disc contact and moving a second predetermined distance causing said second convex disc contact to flex and be in electrical contact with a base contact.

18. The method as recited in claim 17 comprises the step of providing respective stages of said tactile feedback by the flexing of said first convex disc contact and said second convex disc contact in response to movement of said applied pressure to said first predetermined distance and said second predetermined distance, said first convex disc contact and said second convex disc contact returning to their original non-flex state when said applied pressure is removed.

19. The method as recited in claim 17 wherein said step of providing said first convex disc contact comprises the step of providing a recessed means at the center of said disc for concentrating said applied pressure on said second convex disc contact.

20. The method as recited in claim 17 comprises the step of providing a plate means for retaining said actuator means within said switch assembly.

21. The method as recited in claim 20 comprises the step of providing an opening in said plate means for a push button portion of said actuator means to extend through for operator access.

22. The method as recited in claim 17 wherein said step of supporting said first convex disc contact above said second convex disc contact in a base means comprises the step of providing a first plurality of multi-sided bins for positioning said tabs of said first convex disc contact in a first plane, and providing a second plurality of multi-sided bins for positioning said tabs of said second convex disc contact, said second plurality of multi-sided bins being positioned approximately forty-five degrees from said first plurality of said multi-sided bins in a second plane above said first plane.

23. The method as recited in claim 17 wherein said method comprises the step of connecting a first terminal to said first convex disc contact, said first terminal extending outside said base means.

24. The method as recited in claim 17 wherein said method comprises the step of connecting a second terminal to said second convex disc contact, said second terminal extending outside said base means.

25. The method as recited in claim 17 wherein said method comprises the step of connecting a third terminal to said base contact within said base means, said third terminal extending outside said base means.

26. A method of providing a dual tactile switch assembly comprising the steps of:

supporting convex contacts of said switch assembly in a base means;

positioning a plurality of tabs of a first of said convex contacts in contact means provided in a first plane within said base means;

securing a plurality of tabs of a second of said convex contacts in contact means provided in a second plane in said base means below said first plane, said second of said convex contacts tabs being displaced approximately forty-five degrees relative to said tabs of said first of said convex contacts below said first plane;

positioning an actuator means above said first of said convex contacts for causing said first of said convex contacts to flex, when pressure is applied to move said actuator means a predetermined distance, thereby causing said first of said convex contacts to come into electrical contact with said second of said convex contacts, and with additional pressure applied to move said actuator a second predetermined distance, causing said second of convex contacts to flex and be in electrical contact with a base contact, said first of said convex contacts and said second of said convex contacts returning to a non-flex state when said applied pressure is removed; and retaining said actuator means within said switch assembly, with plate means having at least two sides for attaching to at least two opposite sides of said base means.

* * * * *